US005106215A

United States Patent [19]

Kitahara et al.

[11] Patent Number: 5,106,215

[45] Date of Patent: Apr. 21, 1992

[54] TRANSFER PRINTER WITH REMOVABLE PRINT HEAD

[75] Inventors: Satoshi Kitahara, Mishima; Osamu Koizumi, Shizuoka; Ikuzo Sugiura, Sagamihara, all of Japan

[73] Assignee: Tokyo Electric Co., Ltd., Tokyo, Japan

[21] Appl. No.: 675,982

[22] Filed: Mar. 26, 1991

[30] Foreign Application Priority Data

Mar. 30, 1990 [JP] Japan ..... 2-83958

[51] Int. Cl.[5] ..... B41J 1/56

[52] U.S. Cl. ..... 400/175; 400/692; 400/120; 400/208; 400/196

[58] Field of Search ..... 400/692, 120, 175, 207, 400/208, 208.1, 196, 246, 207 E

[56] References Cited

U.S. PATENT DOCUMENTS

| | | | |
|---|---|---|---|
| 4,632,585 | 12/1986 | Oyamatsu | 400/613 |
| 4,641,980 | 2/1987 | Matsumoto | 400/120 |
| 4,647,234 | 3/1987 | Isobe | 400/120 |
| 4,709,248 | 11/1987 | Piatt | 346/140 R |
| 4,776,714 | 10/1988 | Sugiura et al. | 400/248 |
| 4,855,755 | 8/1989 | Aizawa | 346/76 PH |
| 5,061,100 | 10/1991 | Brower | 400/642 |

FOREIGN PATENT DOCUMENTS

| | | | |
|---|---|---|---|
| 0294792 | 12/1988 | European Pat. Off. . | |
| 0297025 | 12/1988 | European Pat. Off. . | |
| 3517591A1 | 11/1985 | Fed. Rep. of Germany . | |
| 94369 | 5/1985 | Japan | 400/175 |
| 160246 | 7/1987 | Japan | 400/692 |

*Primary Examiner*—Edgar S. Burr
*Assistant Examiner*—Eric P. Raciti
*Attorney, Agent, or Firm*—Frishauf, Holtz, Goodman & Woodward

[57] ABSTRACT

A label printer comprises a supporting frame having a pair of side plates facing each other. A platen roller and a head unit having a print head are arranged between the side plates. A supporting shaft extends parallel to the platen roller and has one end fixed to one of the side plates and a free end adjacent to the other side plate. The head unit is supported on the supporting shaft and located in an operative position wherein the print head is opposite to the platen roller. The head unit is slidable from the operative position to the outside of the supporting frame along the supporting shaft. The free end of the shaft and the head unit in the operative position is fixed by a fixing member mounted on the other side plate.

14 Claims, 8 Drawing Sheets

TRANSFER PRINTER WITH REMOVABLE PRINT HEAD

BACKGROUND OF THE INVENTION

1. Field of the Invention

The present invention relates to a transfer printer, such as a label printer for printing item names, bar codes, etc. on labels, and more particularly, to a transfer printer in which a transfer ribbon in contact with printing paper is heated by means of a print head to transfer ink on the ribbon to the paper, thereby effecting printing.

2. Description of the Related Art

A transfer printer, e.g., a label printer for printing item names, bar codes, etc. on labels, comprises a printing section which includes a platen roller and a line thermal head adapted to be pressed against the roller. A supply shaft and a take-up shaft for a transfer ribbon are located over the printing section. When the take-up shaft is rotated by means of a motor and the like, the transfer ribbon is fed out from the supply shaft, transported past a guide shaft and the printing section, and taken up by means of the take-up shaft. The supply shaft is connected with a load mechanism. A desired back tension is applied to the transfer ribbon by damping the rotation of the supply shaft by means of the load mechanism.

In the conventional printer, however, the thermal head must be attached or detached for replacement or cleaning in a narrow space within the printer body. In this case, therefore, the operation is hindered by other components in the printer body, so that the working efficiency is not very high.

SUMMARY OF THE INVENTION

The present invention has been contrived in consideration of these circumstances, and its object is to provide a transfer printer in which a print head can be replaced and cleaned with ease.

In order to achieve the above object, a transfer printer according to the present invention comprises: a body having first and second supporting portions facing each other; a platen extending between the first and second supporting portions; a head unit including a print head; supporting means arranged on the body, for supporting the head unit in an operative position in which the print head is opposed to the platen so that the head unit is drawable from the operative position to the outside of the body in a longitudinal direction of the platen; and means for fixing the head unit to the operative position.

According to the printer constructed in this manner, the print head can be mounted on or removed from the body by only moving the head unit along the supporting means attached to the body. After the head unit is moved to the operative position in the body, play of the print head can be prevented by fixing the head unit to the body by means of the fixing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 10 show a label printer according to an embodiment of the present invention, in which:

FIG. 1 is a perspective view showing an external appearance of the printer;

FIG. 2 is a front view of the printer with its casing off;

FIG. 3 is a side view, partially in section, showing the printer with its casing off;

FIG. 4 is an exploded perspective view showing the principal mechanism of the printer;

FIG. 5 is an exploded perspective view showing a state in which a head unit is drawn out from a supporting frame;

FIG. 6 is a perspective view showing the principal mechanism of the printer in which a fixing member is in a fixing position;

FIG. 7 is a perspective view schematically showing a supporting mechanism in which a slider carrying a ribbon unit thereon is drawn out;

FIG. 8 is a front view of a shaft end portion;

FIG. 9 is a side view of a rotating shaft end portion; and

FIG. 10 is a front view of the rotating shaft end portion.

DETAILED DESCRIPTION OF THE PREFERRED EMBODIMENT

An embodiment, in which a transfer printer according to an embodiment of the present invention is applied to a label printer, will now be described in detail with reference to the accompanying drawings.

Figure 1:
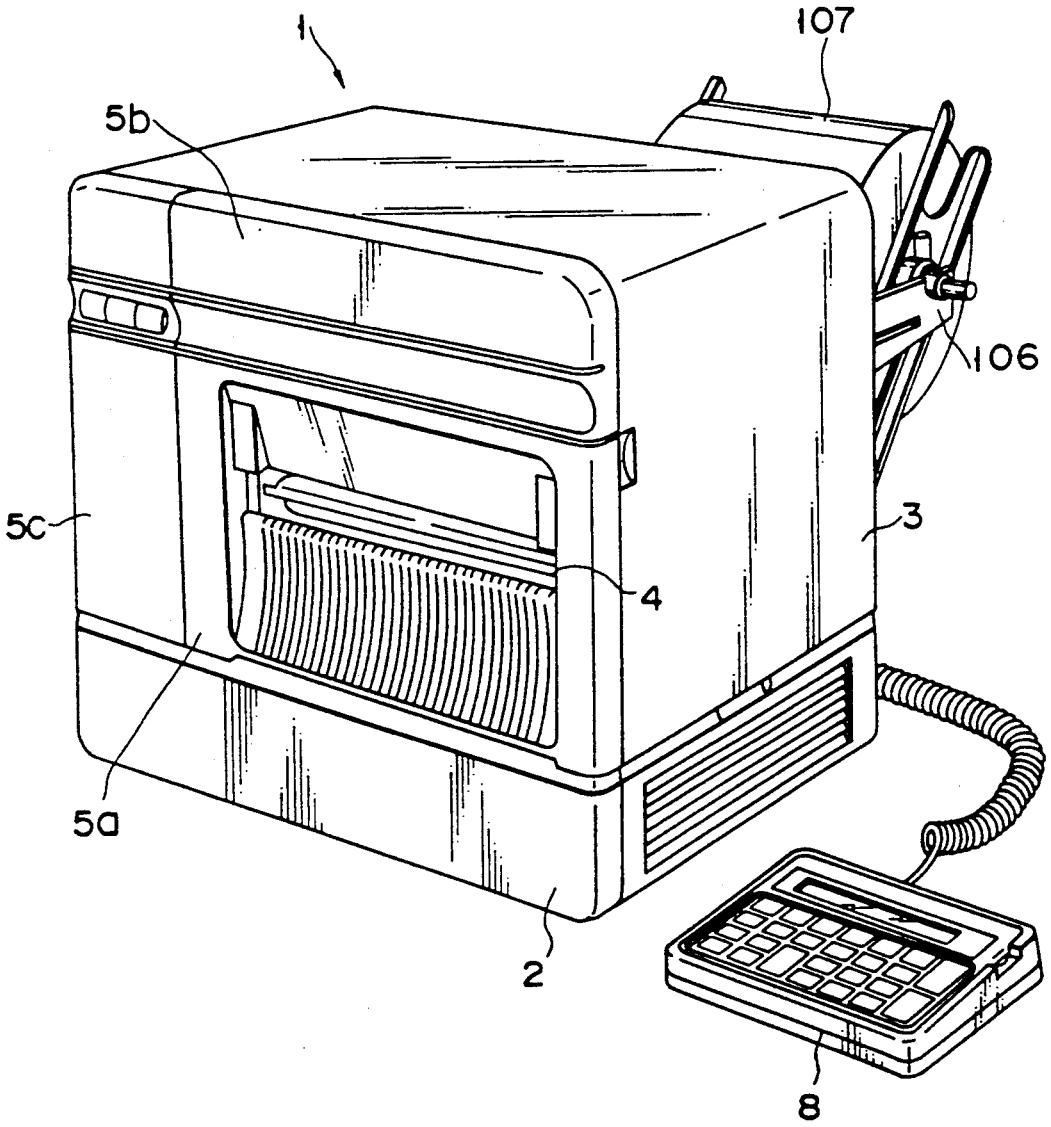
Figure 2:
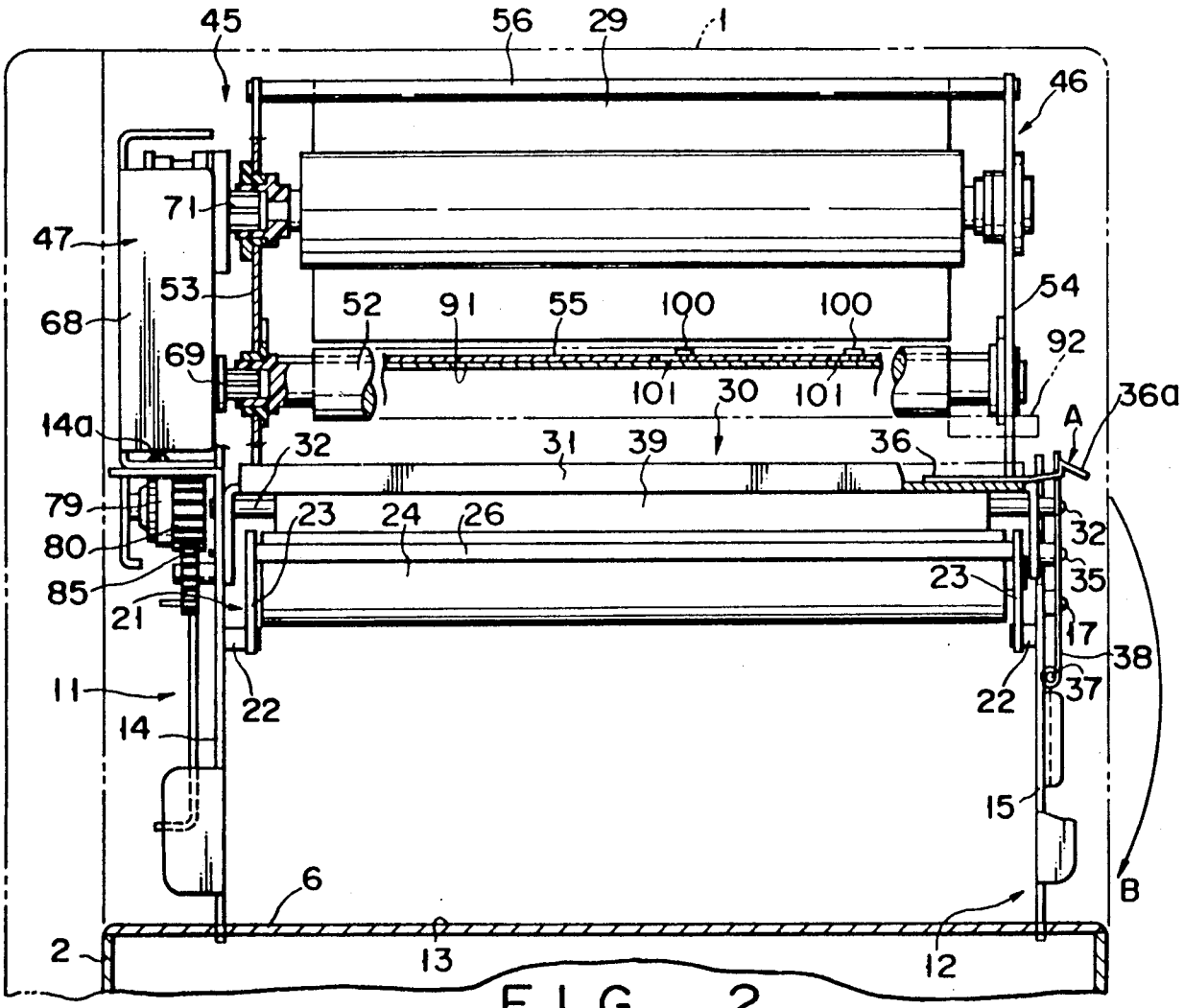
Figure 3:
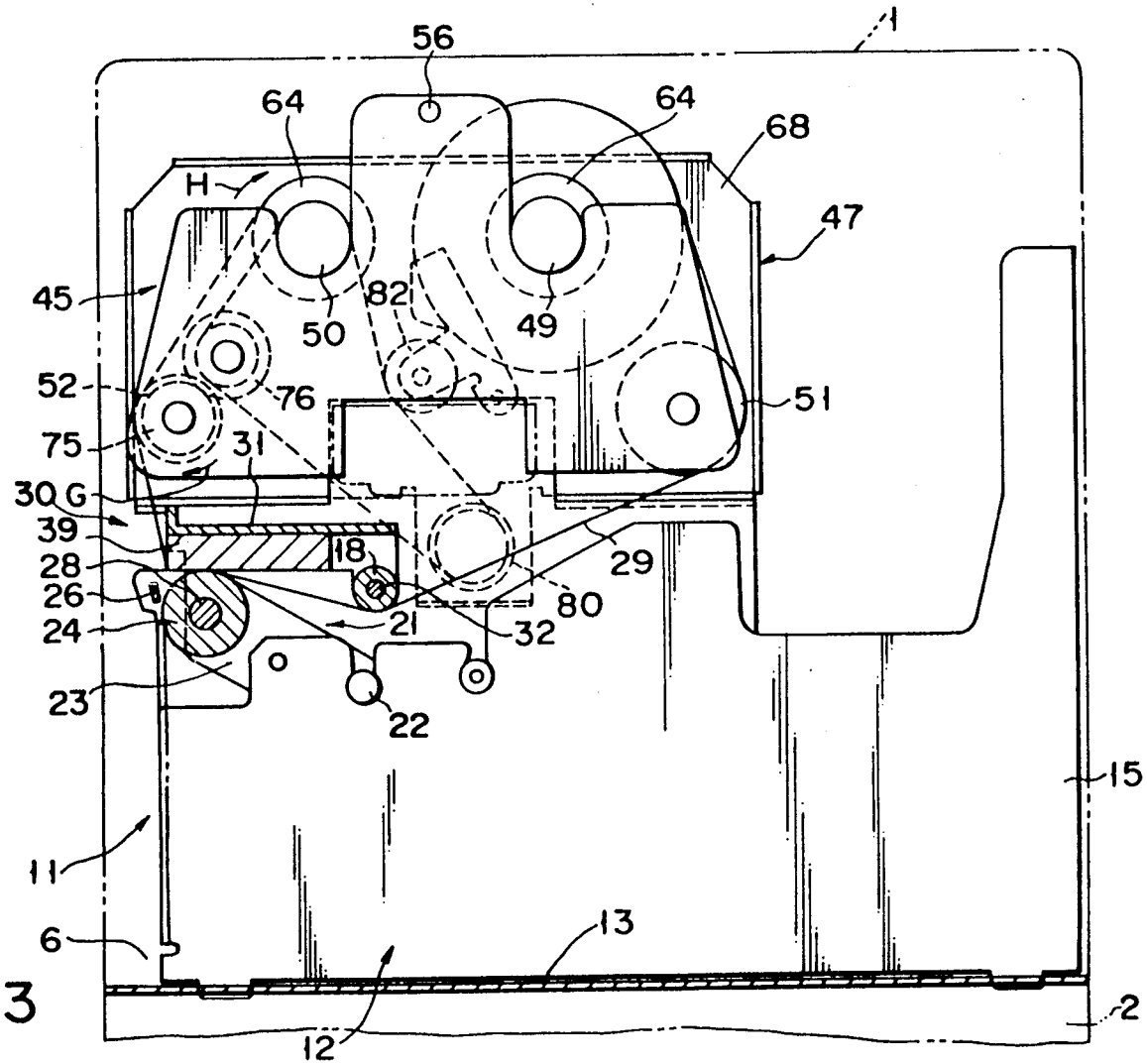

As shown in FIGS. 1 to 3, the label printer has a body casing 1 in the form of a substantially rectangular box. The casing 1 includes a rectangular base 2, a U-shaped side panel 3 having a pair of side walls and a top wall, integral with one another, and removably mounted on the base 2, and an L-shaped first front panel **5*a* removably mounted on the base 2 and having an outlet port 4 through which printed paper is discharged. The casing 1 further includes a second front panel 5*b* formed integrally with the side panel 3 so as to be continuous with the upper portion of the first front panel 5*a*, and a third front panel 5*c* fixed to the base 2 and situated beside and continuous with the first and second front panels. In FIG. 1, reference numeral 8** denotes a controller for entering print information into the printer.

A printing mechanism 11 is disposed in the body casing 1. The following is a description of the mechanism 11.

As shown in FIGS. 2 and 3, the printing mechanism 11 includes a body frame 12 which constitutes a main body of the printer in association with the casing 1. The frame 12 is formed of a horizontal bottom plate 13, fixed to the upper surface of the base 2 of the casing 1, and frame side plates 14 and 15 set up on the left and right end portions of the bottom plate, respectively, these plates being connected to one another. The two side plates 14 and 15 stand upright so as to face each other.

The printing mechanism 11 further includes a platen unit 21, which is located between the frame side plates 14 and 15 and rockably supported by the same. The unit 21 includes a pair of support shafts 22, two end plates 23, a platen roller 24, and a torsion spring (not shown).

The support shafts 22 are nonrotatably fixed to the respective end plates 14 and 15. The two end plates 23, which face each other, are each in the form of a flat plate, and are arranged adjacent to the side plates 14 and 15, respectively. The respective rear end portions of the end plates 23 are mounted on the support shafts 22 so as to be individually rockable around it.

A bearing (not shown) is mounted on the front end portion of each end plate 23. A platen shaft 28 of the platen roller 24 penetrates these bearings to be supported thereby. Thus, the roller 24 is stretched substantially horizontally between the respective front end portions of the two end plates 23. One end portion of the platen roller 24 is connected to a paper feeding mechanism (not shown) so that the roller 24 is driven in association with the feeding mechanism. A separating plate 26 extends between the respective front end portions of the end plates 23 and situated adjacent to the front portion of the platen roller 24.

As shown in FIGS. 2 to 5, a head unit 30 is located above the platen unit 21. It includes a substantially rectangular head frame 31, bent at right angles at both ends, and a thermal head 39 for use as a print head fixed to the lower surface of the frame 31.

Figure 5:
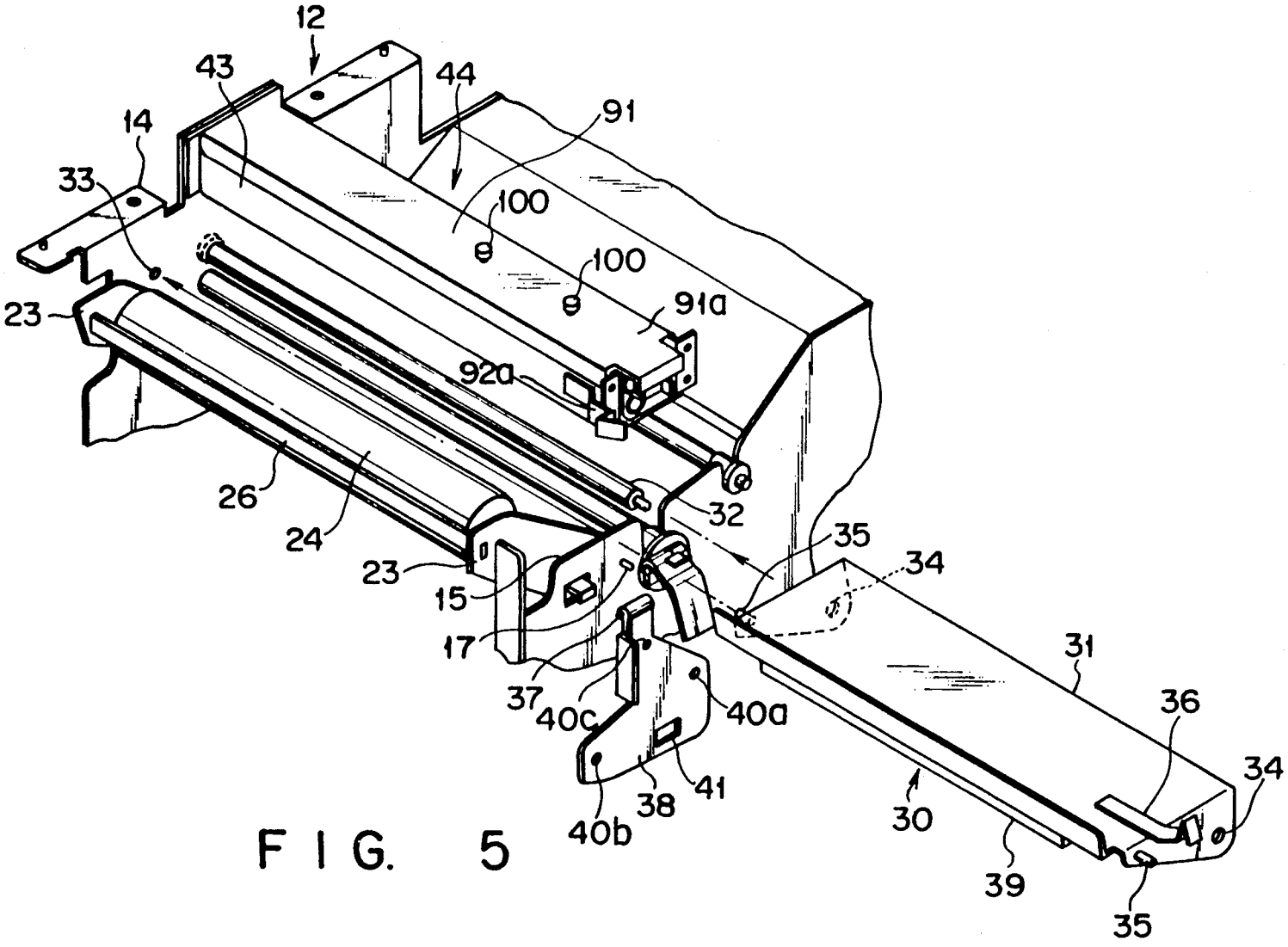

The head unit 30 is mounted by means of a mounting structure shown in FIG. 5. One end portion of a supporting shaft 32 is fixed like a cantilever to the frame side plate 14 of the body frame 12. The shaft 32 extends parallel to the platen roller 24, and its free end passes over the other frame side plate 15 and barely projects to the outside of the frame 12. A supporting hole 33 is bored through the side plate 14. An engaging hole 34 is bored through the rear portion of each side wall of the head frame 31, while a fixing pin 35 protrudes from the front portion of each side wall. A leaf spring or retaining plate 36 is fixed to that end portion of the upper surface of the frame 31 on the side of the side plate 15, so as to project toward the plate 15.

The head unit 30 is supported like a cantilever such that the supporting shaft 32 is slidably passed through the pair of engaging holes 34 of the head frame 31, and one of the fixing pins 35 is fitted in the supporting hole 33 in the side plate 14.

A fixing plate 38 is rockably mounted on the outer surface of the frame side plate 15 by means of a hinge 37, and a positioning pin 17 protrudes from the plate 15 to be situated over the hinge 37. First, second, and third engaging holes 40*a*, 40*b* and 40*c* and a rectangular hole 41 are bored through the fixing plate 38.

Figure 6:
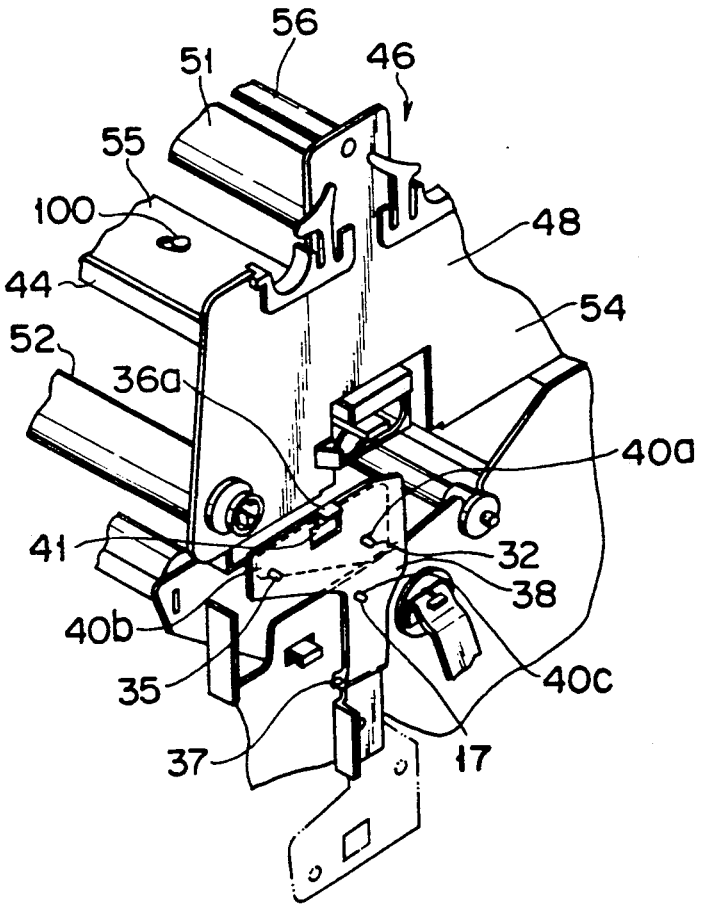
Figure 7:
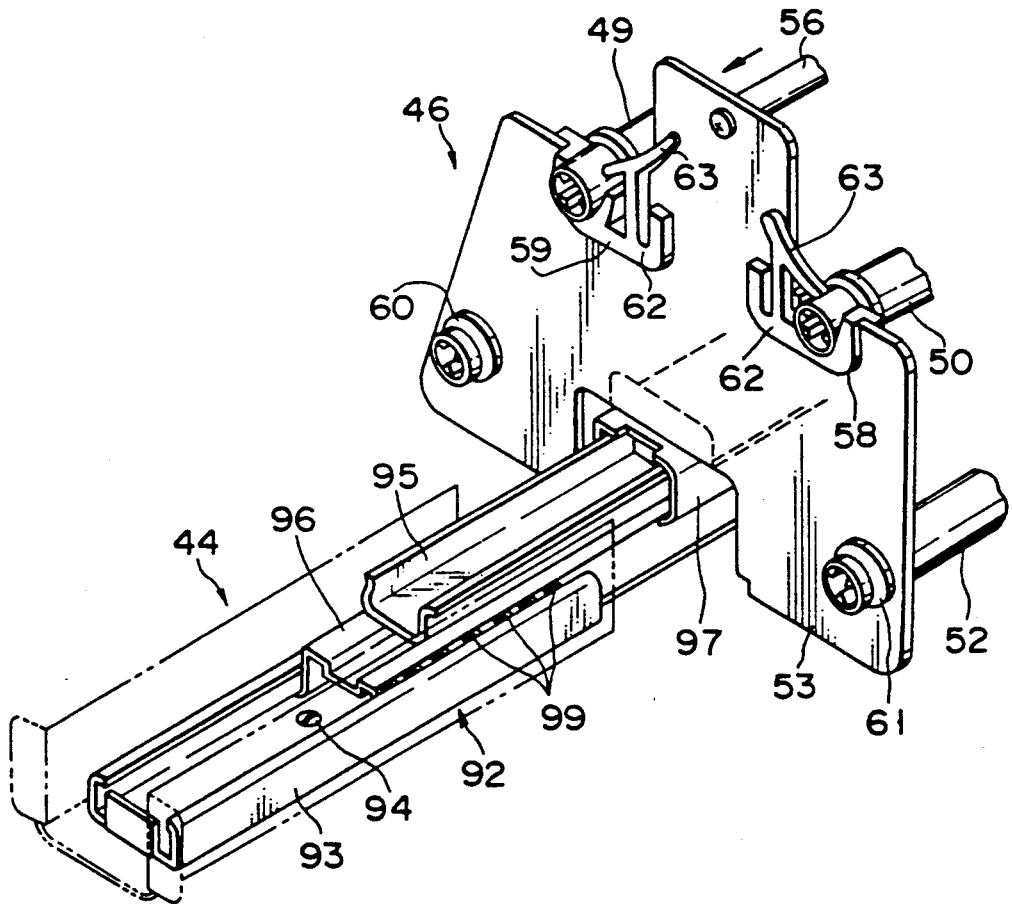

When the fixing plate 38 is rocked upward around the hinge 37 to a fixing position shown in FIG. 6, the free end of the supporting shaft 32, the other fixing pin 35, and the positioning pin 17 engage the first, second, and third engaging holes 40*a*, 40*b* and 40*c*, respectively, as shown in FIG. 6. In this manner, the free end of the shaft 32 and that end of the head frame 31 on the side of the side plate 15 are supported by means of the fixing plate 38. Thus, the shaft 32 and the frame 31 are supported at both ends. When the fixing plate 38 is rocked to the fixing position, moreover, the distal end of the retaining plate 36 of the head frame 31 engages the rectangular hole 41 of the plate 38. As a result, the fixing plate 38 is locked to the fixing position, so that the frame 31 is kept supported. In this state, the head unit 30 is kept in its operative position, and the thermal head 39 is in contact with the platen roller 24, facing the same in parallel relation.

When the fixing plate 38 is rocked downward in the direction of arrow B of FIG. 2 after a distal end portion 36*a* of the retaining plate 36 is depressed in the direction of arrow A, the plate 38 is disengaged from the supporting shaft 32 and the head frame 31. As a result, the frame 31 is released from the support on the side of the side plate 15. The head unit 30 can be removed from the body frame 12 by being drawn out along the supporting shaft 32 in this state. In mounting the head unit 30 in the operative position in the body frame 12, it is necessary only that the fixing plate 38 be rocked to the fixing position after the head frame 31 is slidingly pushed along the shaft 32 into the frame 12.

As shown in FIG. 3, a guide roller 18 for guiding a transfer ribbon 29 (described later) is rotatably mounted on the supporting shaft 32 which supports the head frame 31.

As shown in FIGS. 4 to 7, a ribbon supporting mechanism 44 for supporting the ribbon unit 46 of a ribbon supply device 45 (mentioned later) is arranged above the head frame 31. The supporting mechanism 44 includes a fixed arm 43, which has a U-shaped cross section and extends parallel to the platen roller 24, and an elongated slider 91 mounted on the arm 43 so as to be slidable in the axial direction of the roller 24 by means of a guide mechanism 92. The ribbon unit 46 is removably mounted on the slider 91.

More specifically, one end of the fixed arm 43 is fixed to the frame side plate 14, while the other end extends close to the frame side plate 15. Thus, the arm 43 is supported like a cantilever. A pair of leaf springs or retaining plates 92*a* for elastically fixing the ribbon unit 46 on the slider 91 are fixed individually to the opposite side faces of the distal end portion of the arm 43. The profile of the side plate 15 is lower than that of the side plate 14 so that the region facing the fixed arm 43 and the ribbon frame 31 on the side of the plate 15 is open. The upper surface of the slider 91 extends parallel to the platen roller 24 or horizontally, and constitutes a supporting surface 91*a* on which the ribbon unit 46 is placed.

The guide mechanism 92 includes a lower rail 93, a pair of intermediate rails 95 and 96, and an upper rail 97. Extending parallel to the fixed arm 43, these rails are substantially as long as the arm 43. The lower rail 93 is fixed to the bottom of the fixed arm 43 by means of a screw 94. The intermediate rail 96 is inserted in the lower rail 93, and a large number of guide rollers 99 are arranged between the rails 93 and 96. Thus, the intermediate rail 96 is axially slidable with respect to the lower rail 93.

The intermediate rail 95 is fixed on the intermediate rail 96, and the upper rail 97 is slidably fitted on the rail 95. The slider 91 is fixed to the upper rail 97 by means of a pair of screws 98. Thus, the slider 91 is slidable between a first position shown in FIG. 4 and a second position. In the second position, the whole body of the slider 91 projects from the casing 1.

A pair of engaging pins 100 are fixed to the support surface 91*a* of the slider 91 by means of the screws 98. These pins 100 are situated at a predetermined distance from each other along the axial direction of the slider 91. The upper end portion of each pin 100 is greater in diameter than its lower end portion.

As shown in FIGS. 2 through 3, the ribbon unit 46 of the ribbon supply device 45 is removably mounted on the slider 91 of the supporting mechanism 44 in a straddling manner.

The ribbon unit 46 includes a ribbon supporting frame 48, a supply shaft 49, a take-up shaft 50, a tension shaft 51, and a ribbon drive shaft 52.

In the ribbon supporting frame 48, the respective bottom portions of a pair of opposite side plates 53 and 54 are connected to each other by means of a lower cross member 55, and lugs 57 protruding individually from the center of the respective top portions of the side plates 53 and 54 are connected to each other by means of an upper cross member 56. The upper cross member 56, which is formed of a round rod, serves as a carrying handle for the ribbon unit 46.

The lower cross member 55 is formed having two pairs of 8-shaped holes 101. The engaging pins 100 of the slider 91 individually engage one pair of holes 101, whereby the ribbon unit 46 is retained on the slider 91. The two pairs of holes 101 are arranged symmetrically with respect to the center of the lower cross member 55 as viewed in the longitudinal direction.

A pair of first upper bearings 58 are individually mounted facing each other on the respective upper portions of the side plates 53 and 54 and are situated in front of their corresponding lugs 57. Also, a pair of second upper bearings 59 are mounted facing each other at the back of the lugs 57. A pair of bearings 60 are individually mounted facing each other on the respective lower front portions of the side plates 53 and 54, while a pair of bearings 61 are mounted facing each other on the respective lower rear portions of the plates 53 and 54.

The bearings 58 and 59, which are formed of synthetic resin, each include an open-topped U-shaped bearing portion 62 and a hook portion 63 situated in close vicinity to the top of the portion 62. The proximal part of the hook portion 63 is thinned to enable elastic deformation. As this proximal part is elastically deformed, the hook portion 63 can move close to or away from the open top of the bearing portion 62.

Two opposite axial end portions 49*a* of the supply shaft 49 are rotatably supported individually by means of the second upper bearings 59 on the rear side of the ribbon supporting frame 48 so that the shaft 49 extends transversely between the two side plates 53 and 54. The shaft 49 is removably mounted on the bearings 59. More specifically, the hook portions 63 are pressed against the respective upper peripheral surfaces of their corresponding shaft end portions 49*a* of the supply shaft 49, which are supported by means of the bearings 59. Thus, the supply shaft 49 is prevented from being unexpectedly disengaged upward from the upper bearings 59. The supply shaft 49 can be removed from the frame 48 by being only manually pulled up. If the shaft 49 is drawn upward, the hook portions 63 undergo elastic deformation, so that the shaft end portions 49*a* are disengaged upward from their corresponding bearing portions 59. Thus, the supply shaft 49 can be removed.

Shaft end portions 50*a* on the opposite sides of the take-up shaft 50 are rotatably supported individually by means of the first upper bearings 58 on the front side of the ribbon supporting frame 48 so that the shaft 50 extends transversely between the two side plates 53 and 54. The shaft 50 is removably mounted on the bearings 58. Since this take-up shaft 50 is attached and detached in the same manner as the supply shaft 49, a description of the procedure of operation for the attachment and detachment is omitted.

The supply and take-up shafts 49 and 50 are identical in size and shape. Thus, these shafts 49 and 50 can be mounted on the two pairs of bearings 58 and 59 on the ribbon supporting frame 48 while being replaced with each other in the aforementioned procedure of operation.

The supply and take-up shafts 49 and 50 and the two pairs of bearings 58 and 59, front and rear, are located symmetrically with respect to an imaginary plane which passes through the center of the ribbon unit 46, as viewed in the depth direction, or extends parallel between the shafts 49 and 50.

Each of the supply and take-up shafts 49 and 50 is removably fitted with cylindrical cores 64 on which a transfer ribbon 29 (mentioned later) are wound. The core 64 is provided at its end portion with a notch (not shown), and a projection (not shown) formed on the supply shaft 49 is fitted in the notch, thereby preventing the core from rotating relative to the shaft 49. The ribbon 29 is wound around the core 64 supported on the supply shaft 49. After being drawn out from the shaft 49 and transported past the tension shaft 51 and the ribbon drive shaft 52 in succession, the ribbon 29 is reeled up onto the core 64 supported on the take-up shaft 50. That portion of the transfer ribbon 29 which extends between the tension shaft 51 and the ribbon drive shaft 52 passes between the platen roller 24 and the line thermal head 39 which constitute a printing section.

Shaft end portions 52*a* on the opposite sides of the ribbon drive shaft 52 are rotatably supported individually by means of the bearings 60 so that the shaft 52 extends transversely between the two side plates 53 and 54. Thus, the shaft 52 is situated between the printing section and the ribbon set shaft 50, on the front side of the head frame 31. The transfer ribbon 29 running from the printing section toward the take-up shaft 50 is wound around the outer circumferential surface of the ribbon drive shaft 52. That portion of the circumferential surface of the shaft 52 which is in contact with the ribbon 29 is formed of a material, e.g., rubber, which ensures a great force of friction with the ribbon 29.

Shaft end portions 51*a* on the opposite sides of the tension shaft 51 are rotatably supported individually by means of the bearings 61 so that the shaft 51 extends transversely between the two side plates 53 and 54. Thus, the shaft 51 is situated between the printing section and the supply shaft 49, on the rear side of the head frame 31. The transfer ribbon 29 running from the supply shaft 49 toward the printing section is wound around the outer peripheral surface of the tension shaft 51. The circumferential surface of the shaft 51, which is in contact with the ribbon 29, is also formed of rubber or other high-friction material.

The tension shaft 51 has the same size and shape as the ribbon drive shaft 52. The shafts 51 and 52 and the two pairs of bearings 60 and 61, front and rear, are located symmetrically with respect to the aforesaid imaginary plane. Thus, the four rotatable shafts 49, 50, 51 and 52 on the ribbon supporting frame 48 are arranged symmetrically with respect to the center in the imaginary plane of the ribbon unit 46.

Figure 8:
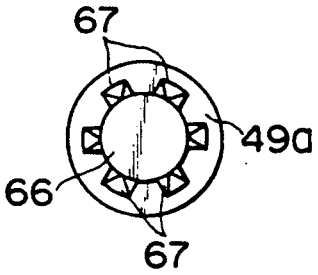

As shown in FIG. 8, each of the shaft end portions 49*a*, 50*a*, 51*a* and 52*a* is formed having a connecting hole 66. With respect to one of the shaft end portions 49*a*, by way of example, three grooves 67 are formed at regular intervals on the inner circumferential surface of the connecting hole 66 so as to extend in the axial direction.

Figure 4:
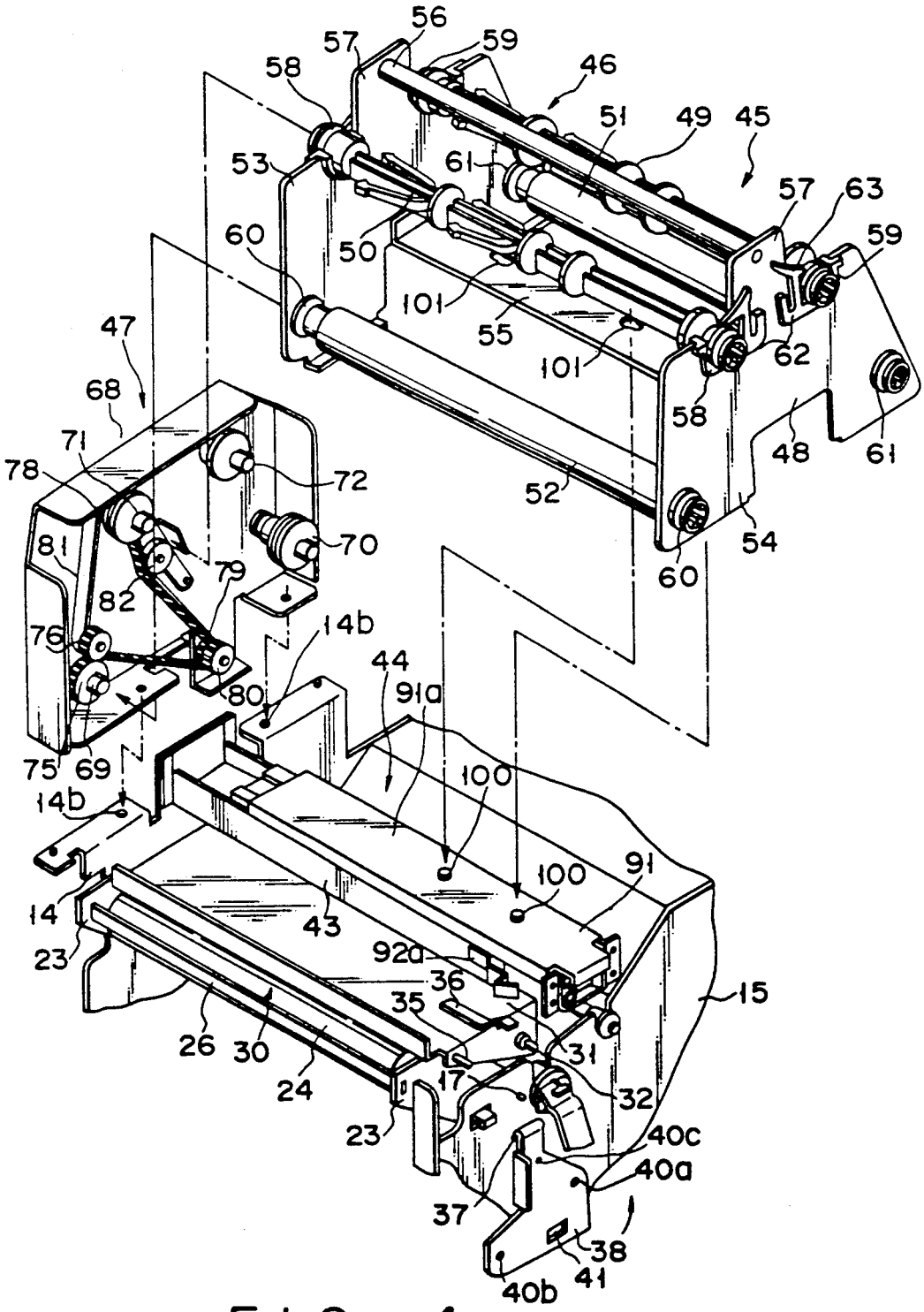

Referring now to FIGS. 2 to 4, a ribbon drive section 47 will be described. This drive section 47 includes a rectangular base 68 whose side edge portions are bent at right angles. A horizontal plate portion of the base 68 on the lower side is fixed to the upper surface of the end portion of the frame side plate 14 by means of screws 14a. Four rotating shafts 69, 70, 71 and 72 protrude horizontally from a vertical plate portion of the base 68. The shafts 69, 70, 71 and 72 are arranged corresponding to the shafts 52, 51, 50 and 49, respectively, of the ribbon unit 46.

A gear 75 is mounted coaxially on the rotating shaft 69 at the lower front portion of the base 68, and a gear 76 is in mesh with the gear 75. A toothed pulley 77 is mounted coaxially on the gear 76. A pulley 78 is integrally provided on the rotating shaft 71 at the upper front portion of the base 68, and a toothed pulley 79 and a driving gear 80 are arranged coaxially in the center of the lower portion of the base 68. A timing belt 81 is passed around and between the pulleys 77, 78 and 79. A tension roller 82 is pressed against the belt 81, thereby applying a tension to the belt 81.

The driving gear 80 is in mesh with a gear 85 of a drive system for the platen roller 24. Thus, the ribbon drive section 47 is driven in synchronism with the roller 24.

Figure 9:
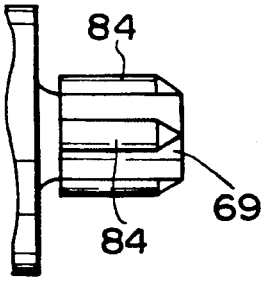
Figure 10:
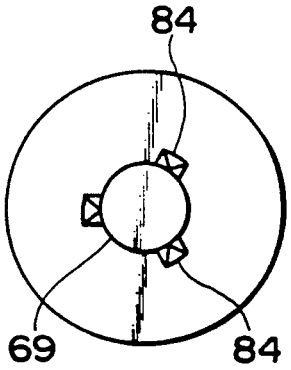

As shown in FIGS. 9 and 10, for example, each of the rotating shafts 69, 70, 71 and 72 has three axial projections 84 on its outer circumferential surface. When the rotating shafts 69, 70, 71 and 72 are inserted into the connecting holes 66 of the corresponding shafts of the ribbon unit 46, the projections 84 of each shaft are fitted into the grooves 67 in the connecting hole 66, thereby enabling power transmission. The tip end portion of each projection 84 is also tapered.

In the thermal printer with this construction, the transfer ribbon 29 is set in the following manner, with the side panel 3 (see FIG. 1) off the body casing 1.

First, the platen roller 24 is rocked downward around the support shafts 22 to be separated from the thermal head 39. Also, the fixing pate 38 is rocked to a release position shown in FIGS. 4 and 5, so that the flank of the head unit 30 is exposed.

Subsequently, the transfer ribbon 29 is set on the ribbon supporting frame 48, and that portion of the ribbon situated between the tension shaft 51 and the ribbon drive shaft 52 is drawn out downward to form a small sag. Then, the slider 91 is drawn out from the casing 1. After the slider 91 is passed over the drawn-out portion of the ribbon 29, the ribbon unit 46 is mounted on the slider 91. At this time, the pair of engaging pins 100 of the slider 91 are fitted into their corresponding engaging holes 101 of the lower cross member 55, thereby retaining the unit 46. After being held in position in this manner, the ribbon unit 46, along with the slider 91, is pushed into the body casing 1. As a result, the slider 91 moves, and the rotating shafts 69, 70, 71 and 72 of the ribbon drive section 47, which is fixed on the frame side plate 15, are fitted into the respective connecting holes 66 of their corresponding shafts 52, 51, 50 and 49 of the ribbon unit 46 to be connected thereto.

When the ribbon unit 46 moves along the fixed arm 43, the sagging portion of the transfer ribbon 29 is passed between the platen roller 24 and the line thermal head 39 which are separated from each other. After the ribbon 29 is set in a predetermined position, the fixing plate 38 is rocked to the fixing position.

Further, paper is drawn out from a paper roll 107 (see FIG. 1), which is located at the back of the body casing 1, and is introduced into the casing 1 through the rear face thereof. The introduced paper is passed between the platen roller 24 and the line thermal head 39 separated from each other, in a region under the transfer ribbon 29. Thereafter, the take-up shaft 50 is manually rotated to take up the surplus portion of the ribbon 29, so that the ribbon is stretched tight. The platen roller 24 is rocked upward to its initial position. Thus, the thermal head 39 is brought into contact with the roller 24, whereupon the ribbon setting is completed.

That portion of the transfer ribbon 29, set in this manner, which extends from the supply shaft 49 to the take-up shaft 50 is transported past the printing section. When the line thermal head 39 is actuated, therefore, ink of the ribbon 29 is transferred to the labels on the paper, thus effecting printing.

The following is a description of the operation of the ribbon supply device 45 during use of the label printer constructed in this manner. When the platen roller 24 is rotated in association with the operation of the paper feeding mechanism (not shown), the gear 80 of the ribbon drive section 47 is rotated by means of the gear 85. As a result, the timing belt 81 is driven by means of the toothed pulley 79, and the rotating shaft 69 is rotated by means of the gears 76 and 75. Also, the rotating shaft 71 is rotated by means of the toothed pulley 78.

Since the rotating shaft 69 is connected with the ribbon drive shaft 52 of the ribbon unit 46, it rotates in the direction of arrow G of FIG. 3, thereby running the transfer ribbon 29 in contact with the outer circumferential surface thereof. At this time, the take-up shaft 50 is connected to the rotating shaft 71, so that it rotates in the direction of arrow H of FIG. 3, thereby taking up the ribbon 29 transported past the shaft 52.

At this time, moreover, the supply shaft 49 and the tension shaft 51 are driven to rotate by means of the take-up force of the transfer ribbon 29, so that the ribbon 29 is drawn from the supply shaft 49, and a tension is applied to the ribbon 29 by means of the tension shaft 51. In synchronism with the travel of the ribbon 29, the paper also runs in a predetermined direction, and desired information is printed on the labels on the paper by means of the thermal head 39.

After many hours of printing in the aforementioned manner, the thermal head 39 may have to be replaced or cleaned. In such a case, the fixing plate 38 is first rocked downward from the fixing position to be disengaged from the supporting shaft 32, the fixing pin 35 on the side of the side plate 15, and the positioning pin 17. Then, the head unit 30 is pulled out. Thereupon, the unit 30 slides along the supporting shaft 32 to be taken out through the flank of the side plate 15. After the unit 30 is taken out in this manner, the thermal head 39 is replaced with a new one or cleaned. Thereafter, the head unit 30 is mounted on the body frame 12, reversely following the aforementioned procedure.

According to the printer constructed in this manner, the head unit is slidably supported on the supporting shaft which is supported like a cantilever on one of the side plates, and can be loaded into or unloaded from the body casing of the printer along the supporting shaft. Accordingly, the thermal head can be attached to or detached from the head frame with the head unit outside the printer body. Thus, the head can be very easily replaced or cleaned.

After the head unit is set in the operative position in the body casing of the printer, the respective free ends of the supporting shaft and the head frame is fixed by means of the fixing plate. In this manner, the supporting shaft and the head frame can be supported at both ends, so that play of the thermal head can be prevented. Thus, satisfactory printing is ensured.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A transfer printer comprising:

a body having first and second supporting portions facing each other;

a platen extending in a longitudinal direction between the first and second supporting portions;

a head unit including a print head;

means arranged on the body, for supporting the head unit in an operative position in which the print head is opposed to the platen, said support means including means mounting the head unit such that the head unit is movable from the operative position to the outside of the body in the longitudinal direction of the platen; and means for fixing the head unit in the operative position.

2. A printer according to claim 1, wherein said supporting means includes a supporting member extending substantially parallel to the platen and having one end fixed to the first supporting portion and a free end situated in the vicinity of the second supporting portion, and said head unit is movably supported on the supporting member.

3. A printer according to claim 2, wherein said fixing means includes a fixing member mounted on the second supporting portion so as to be movable between a fixing position, in which the fixing member engages the free end of the supporting member and the head unit in the operative position to restrain the free end and the head unit from moving, and a release position, in which the fixing member is disengaged from the free end of the supporting member and the head unit to allow the head unit to be taken out.

4. A printer according to claim 3, wherein said fixing means includes locking means attached to the head unit, for engaging the fixing member in the fixing position to lock the fixing member.

5. A printer according to claim 2, wherein said head unit includes a head supporting frame to which the print head is fixed, the head supporting frame having first and second end portions adjoining the first and second supporting portions, respectively, when the head unit is in the operative position, and coaxial through holes formed individually at the first and second end portions, and said supporting member includes a supporting shaft slidably passed through the through holes.

6. A printer according to claim 5, wherein said first and second end portions of said head supporting frame include first and second engaging projections, respectively, situated at a distance from the through holes, and said first supporting portion includes an engaging portion for engaging the first engaging projection of the head supporting frame in the operative position.

7. A printer according to claim 6, wherein said fixing means includes a fixing member mounted on the second supporting portion and being rotatable between a fixing position, in which the fixing member engages the free end of the supporting shaft and the second projection of the head supporting frame in the operative position to restrain the free end and the head supporting frame from moving, and a release position, in which the fixing member is disengaged from the free end of the supporting shaft and the second projection to allow the head unit to be taken out.

8. A printer according to claim 7, wherein said fixing means includes a retaining member mounted on the head supporting frame, for engaging the fixing member in the fixing position to lock the fixing member.

9. A printer according to claim 8, wherein said retaining member is formed of a leaf spring.

10. A printer according to claim 5, wherein said head unit includes a guide roller rotatably mounted on the supporting shaft, for guiding a transfer medium between the print head and the platen.

11. A printer according to claim 1, which further comprises a ribbon supply device for running a transfer ribbon between the platen and the print head of the head unit situated in the operative position.

12. A printer according to claim 11, wherein said ribbon supply device includes a ribbon unit, removably attached to the body and having first and second rotating shafts wound with the transfer ribbon, and a ribbon drive section fixed to the body, for driving the ribbon unit.

13. A printer according to claim 12, which further comprises unit supporting means for supporting the ribbon unit so that the ribbon unit is movable between a first position in which the ribbon unit engages the ribbon drive section and a second position in which the ribbon unit is situated outside the body.

14. A printer according to claim 13, wherein said unit supporting means includes a fixed arm, having one end fixed to the first supporting portion and a free end situated in the vicinity of the second supporting portion, and a slider supported on the fixed arm for movement parallel to the platen, said ribbon unit being removably mounted on the slider.

* * * * *